US007960954B2

(12) United States Patent
Chen

(10) Patent No.: US 7,960,954 B2
(45) Date of Patent: Jun. 14, 2011

(54) VOLTAGE ADJUSTING APPARATUS

(75) Inventor: Hsiao Wen Chen, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 204 days.

(21) Appl. No.: 12/325,577

(22) Filed: Dec. 1, 2008

(65) Prior Publication Data

US 2009/0230931 A1 Sep. 17, 2009

(30) Foreign Application Priority Data

Mar. 11, 2008 (TW) ..... 97108452 A

(51) Int. Cl.
*G05F 1/565* (2006.01)
*G05F 1/10* (2006.01)
*G05F 1/00* (2006.01)
*G05F 1/573* (2006.01)

(52) U.S. Cl. ..... 323/275; 323/234; 323/265; 323/277

(58) Field of Classification Search ..... 323/235, 323/265, 273, 282, 275, 285, 277
See application file for complete search history.

(56) References Cited

U.S. PATENT DOCUMENTS 5,572,111 A * 11/1996 Dressler et al. ..... 323/273
5,811,895 A * 9/1998 Suzuki et al. ..... 307/125
6,295,217 B1 9/2001 Yang et al.
6,986,067 B2 1/2006 Odaohhara et al.
7,526,659 B2 * 4/2009 Sawyers et al. ..... 713/300
2005/0088466 A1 * 4/2005 Smith et al. ..... 347/5
2005/0231277 A1 * 10/2005 Ogawa ..... 330/98
2008/0246438 A1 * 10/2008 Lu ..... 320/137
2010/0077237 A1 * 3/2010 Sawyers ..... 713/300

FOREIGN PATENT DOCUMENTS

WO WO 2006118021 A1 * 11/2006

* cited by examiner

*Primary Examiner* — Adolf Berhane
*Assistant Examiner* — Jeffrey Gblende
(74) *Attorney, Agent, or Firm* — Tim Tingkang Xia; Morris, Manning & Martin, LLP

(57) ABSTRACT

The invention discloses a voltage adjusting apparatus including a power adaptor, a first resistor, a current detecting module, a second resistor, and a voltage feedback controlling module. The power adaptor outputs a first current first. The first resistor is used to convert the first current to a first voltage. The current detecting module is used to convert the first voltage to a second current. The second resistor is used to convert the second current to a second voltage. The voltage feedback controlling module is used to convert the second voltage to a third voltage. The power adaptor is used to convert the third voltage to a fourth voltage and output the fourth voltage.

2 Claims, 7 Drawing Sheets

VOLTAGE ADJUSTING APPARATUS

BACKGROUND OF THE INVENTION

1. Field of the Invention

The invention relates to a voltage adjusting apparatus and, more particularly, to a voltage adjusting apparatus for adjusting an output voltage of a power adaptor according to a usage state.

2. Description of the Prior Art

A power adaptor is generally composed of a transformer and a rectifier, and it can adjust a voltage to be high or low and output either a direct current (DC) or an alternating current (AC). Some power adaptors do not include a transformer. For a general larger electrical appliance such as a stereo, the power adaptor is hidden in the electrical appliance and mostly is disposed at the place where a power supply is connected. For example, the power adaptor of a computer is disposed at the place where a computer power line is connected. However, in a few portable electrical appliances such as mobile phones, notebook computers, and walkmans, based on the consideration of the volume of the electrical appliance, the power adaptor cannot be placed in the electrical appliance. Therefore, most of the portable electrical appliances use external power adaptors.

Please refer to FIG. 1A. FIG. 1A is a schematic diagram showing a power adaptor 1 converting an AC to a DC according to the prior art. Generally, a conventional power adaptor 1 converts an AC to a DC via a voltage adjusting technique, as shown in FIG. 1A. At that moment, an output voltage is a constant value. For example, the output voltage of a notebook computer is generally 19 V.

FIG. 1B is a schematic diagram showing a circuit of the power adaptor 1 in FIG. 1A. As shown in FIG. 1B, the power adaptor 1 includes three resistors 10, 12 and 14 and a voltage regulator 16. If the output voltage needs to maintain 19 V, the resistance values of the three resistors 10, 12 and 14 should be 16.5 KΩ, 10 KΩ, and 3.3 KΩ, respectively, and the voltage regulator 16 needs to regulate the voltage of a node N1 to maintain 2.5 V. That is, the output voltage=2.5/(3.3K//10K) *16.5K+2.5=19.1.

However, the output voltage needed by a notebook computer in an idle state is usually lower than the output voltage needed in a usage state. If the output voltage is not adjusted with the usage state, the notebook computer may still cause more power supply losses in the idle state, which increases system temperature and reduces the reliability of electronic components. Furthermore, if the system temperature increases, correspondingly, the rotation speed of a fan also needs to increase to accelerate heat dissipation. Once the rotation speed of the fan increases, noise increases with the rotation speed, which makes trouble for users.

Generally speaking, the power supply losses include conduction losses and switching losses.

The conduction losses are the resistance losses in an appliance due to current flowing in the on-state resistance (Rdson) of the mental-oxide-semiconductor field-effect transistor (MOSFET). The conduction losses may be calculated from the following two equations.

$$PCHS = I\text{out}2 * Rd\text{son} * D.$$

$$PCLS = I\text{out}2 * Rd\text{son} * (1-D).$$

PCHS represents the conduction losses of a high side of the MOSFET. PCLS represents the conduction losses of a low side of the MOSFET. D represents a conduction ratio (D=Vout/Vin), where Vout represents an output voltage, and Vin represents an input voltage of a power supply. Tout represents a load current. Rdson represents an on-state resistance of the MOSFET. Since D and Iout are determined by a practical application, Rdson should be chosen as low as possible.

The switching losses are the losses due to switching the high side and the low side of a MOSFET. The switching losses may be calculated from the following two equations.

$$PDHS = \frac{(t_r + t_f) * V_{in} * I_{out} * f_s}{2}$$

$$PDLS = \frac{(t_r + t_f) * V_d * I_{out} * f_s}{2}$$

PDHS represents the switching losses of a high side of the MOSFET. PDLS represents the switching losses of a low side of the MOSFET. tr represents rise time, and tf represents fall time. fs represents a DC-DC converter switching frequency. Vd represents an on-state voltage of a body diode. The rest of the parameters are the same with the above parameters.

When Iout=15 A, Vd=1.5 V, the high side Rdson=9 mΩ, the low side Rdson=5 mΩ, tr+tf=80 ns, and fs=200 kHz, the losses are calculated as shown in table 1.

TABLE 1

| | output voltage (V) | | | | |
|---|---|---|---|---|---|
| | 15 | 16 | 17 | 18 | 19 |
| PCHS + PDHS | 2.003 | 2.11 | 2.219 | 2.329 | 2.44 |
| PCLS + PDLS | 1.193 | 1.2 | 1.206 | 1.211 | 1.216 |
| total losses (W) | 3.196 | 3.31 | 3.425 | 3.54 | 3.656 |

According to table 1, in the same situation, if only the output voltage is reduced, losses are reduced by at most about 15~20% to efficiently achieve an energy-saving effect.

SUMMARY OF THE INVENTION

The invention provides a voltage adjusting apparatus for adjusting an output voltage of a power adaptor with different loads to efficiently reduce power supply losses.

According to an embodiment, a voltage adjusting apparatus of the invention includes a power adaptor, a first resistor, a current detecting module, a second resistor, and a voltage feedback controlling module. The first resistor is coupled with the power adaptor. The current detecting module is coupled with the first resistor. The second resistor is connected to the ground and coupled with the current detecting module. The voltage feedback controlling module is coupled with the power adaptor, the current detecting module, and the second resistor.

In the embodiment, the power adaptor first outputs a first current. The first resistor is used to convert the first current outputted from the power adaptor to a first voltage. The current detecting module is used to convert the first voltage to a second current. The second resistor is used to convert the second current to a second voltage. The voltage feedback controlling module is used to convert the second voltage to a third voltage. The power adaptor is used to convert the third voltage to a fourth voltage and output the fourth voltage.

In the embodiment, the voltage feedback controlling module utilizes an inverting amplifier and two resistors to convert the second voltage to the third voltage. Furthermore, the power adaptor of the invention includes three resistors and a voltage regulator. According to the resistance values of the three resistors, the power adaptor converts the third voltage outputted from the voltage feedback controlling module to the fourth voltage.

In other words, with the variation of an output current of the power adaptor, the power adaptor of the invention can adjust the output voltage via the feedback control of the voltage feedback controlling module, and the configuration of the original power adaptor is not affected. Furthermore, in the invention, the range of the output voltage may be adjusted only by modifying the resistance values of the resistors.

According to the voltage adjusting apparatus of the invention, if a load of an electronic product (such as a notebook computer) is lighter, the output voltage is adjusted down. However, if the load is heavier, the output voltage is adjusted up. Compared with the prior art, the invention can efficiently reduce the power supply losses to achieve the following advantages. First, energy and electricity is saved. Second, system temperature decreases to improve the reliability of electronic components. Third, a rotation speed of a fan decreases to reduce noise.

These and other features, aspects, and advantages of the present invention will become better understood with regard to the following description, appended claims, and accompanying drawings.

BRIEF DESCRIPTION OF THE APPENDED DRAWINGS

DETAILED DESCRIPTION OF THE INVENTION

Figure 1A:
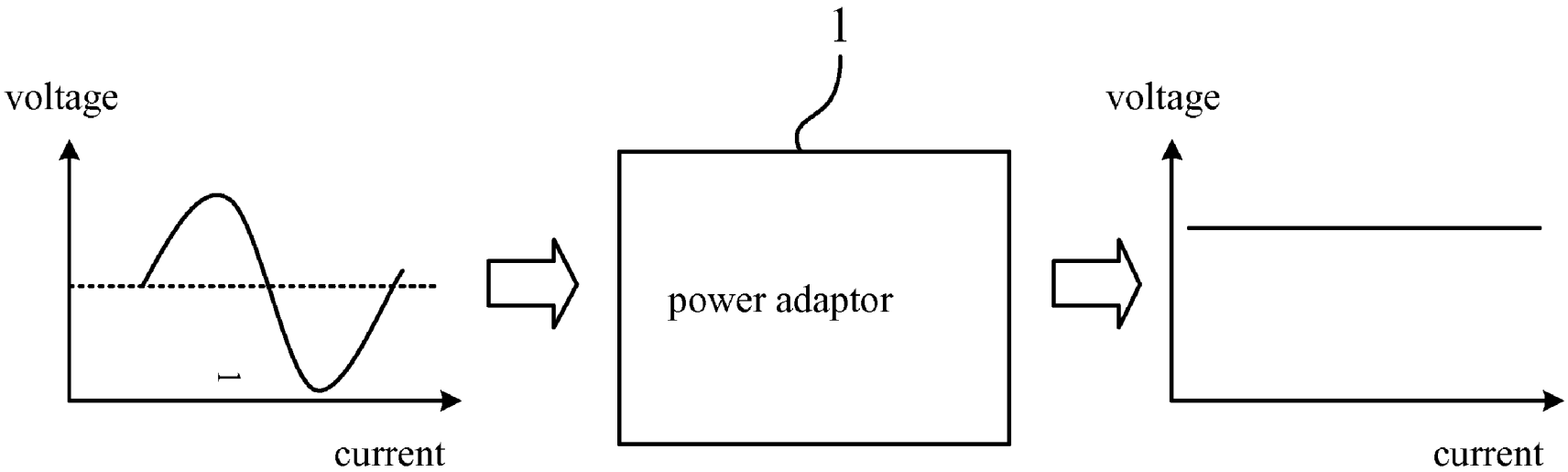
FIG. 1A (Prior Art)
FIG. 1A is a schematic diagram showing a power adaptor converting an alternating current to a direct current according to the prior art.
Figure 1B:
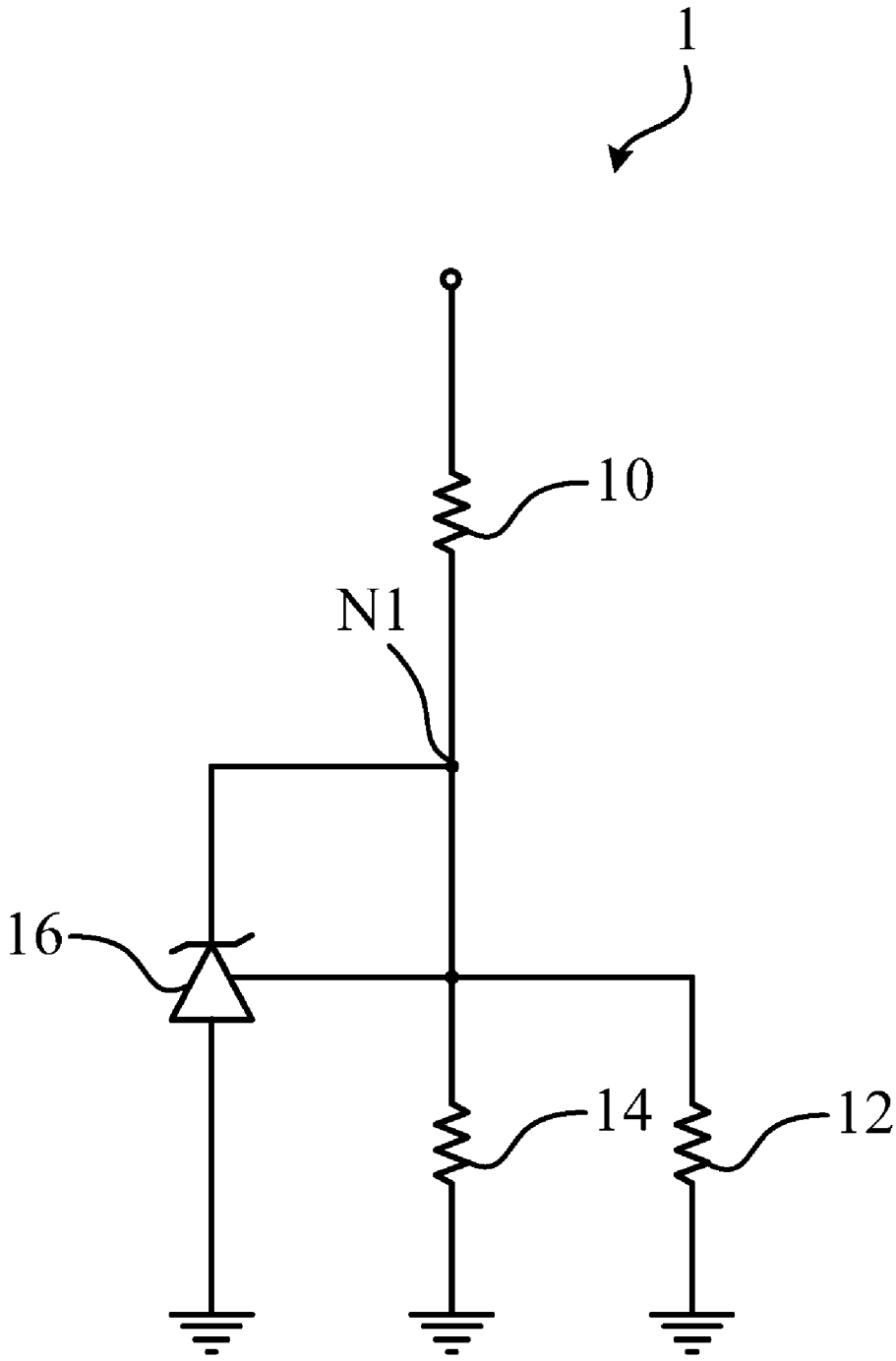
FIG. 1B (Prior Art)
FIG. 1B is a schematic diagram showing a circuit of the power adapter in FIG. 1A.
Figure 2:
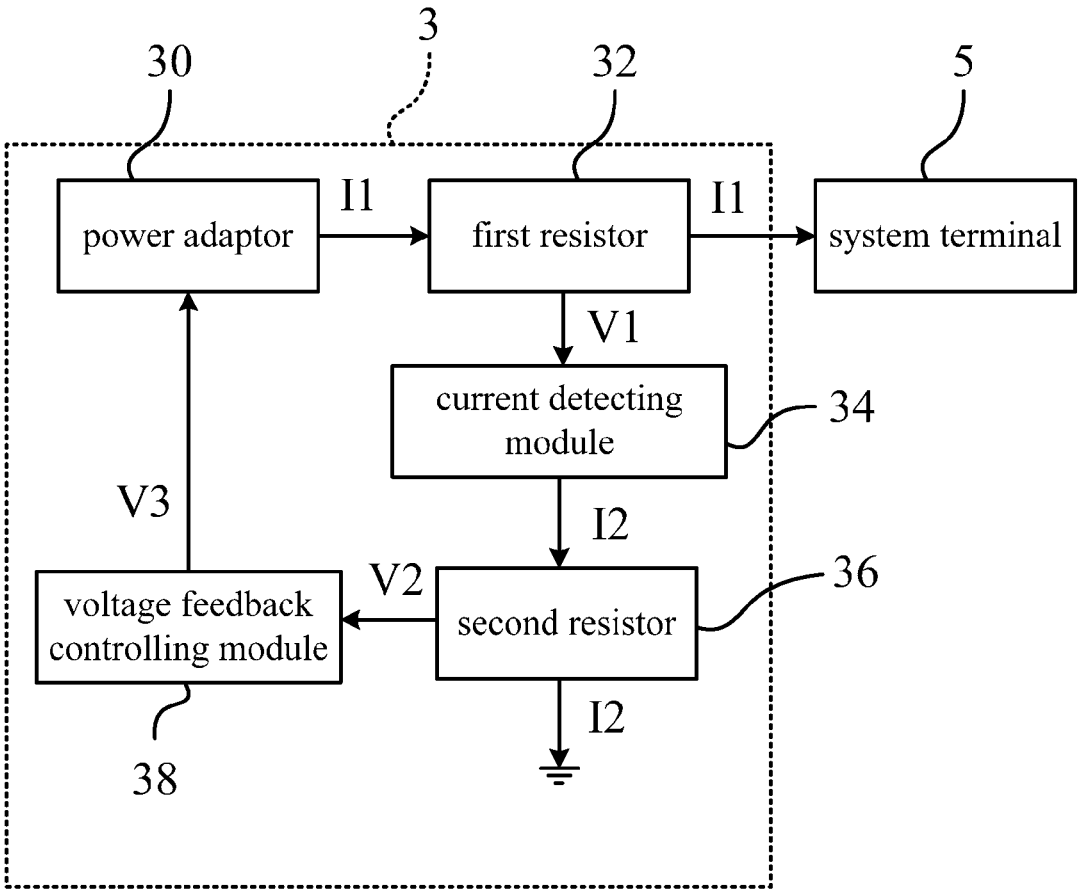
FIG. 2 is a functional block diagram showing a voltage adjusting apparatus according to an embodiment of the invention.

FIG. 2 is a functional block diagram showing a voltage adjusting apparatus 3 according to an embodiment of the invention. As shown in FIG. 2, the voltage adjusting apparatus 3 includes a power adaptor 30, a first resistor 32, a current detecting module 34, a second resistor 36, and a voltage feedback controlling module 38. The first resistor 32 is coupled with the power adaptor 30. The current detecting module 34 is coupled with the first resistor 32. The second resistor 36 is connected to the ground and coupled with the current detecting module 34. The voltage feedback controlling module 38 is coupled with the power adaptor 30, the current detecting module 34, and the second resistor 36. The voltage adjusting apparatus 3 is used to provide a working voltage needed by a system terminal 5. The system terminal 5 may be a notebook computer or another electronic product which needs a power adaptor.

First, in the embodiment, the first resistor 32 is used to detect a first current I1 outputted from the power adaptor 30 to obtain a first voltage V1. In the embodiment, if the resistance value of the first resistor 32 is R1, V1=R1*I1. Preferably, the resistance value R1 of the first resistor 32 may be set to be 10 mΩ, which is not used to limit the scope of the invention. Then the current detecting module 34 converts the first voltage V1 to a second current I2. Since the current detecting module 34 is connected with the second resistor 36 in series, the second current I2 may be converted by the second resistor 36 to obtain a second voltage V2. In the embodiment, if the resistance value of the second resistor 36 is R2, V2=R2*I2. The range of the needed second voltage V2 may be adjusted by adjusting the resistance value R2 of the second resistor 36.

Figure 3:
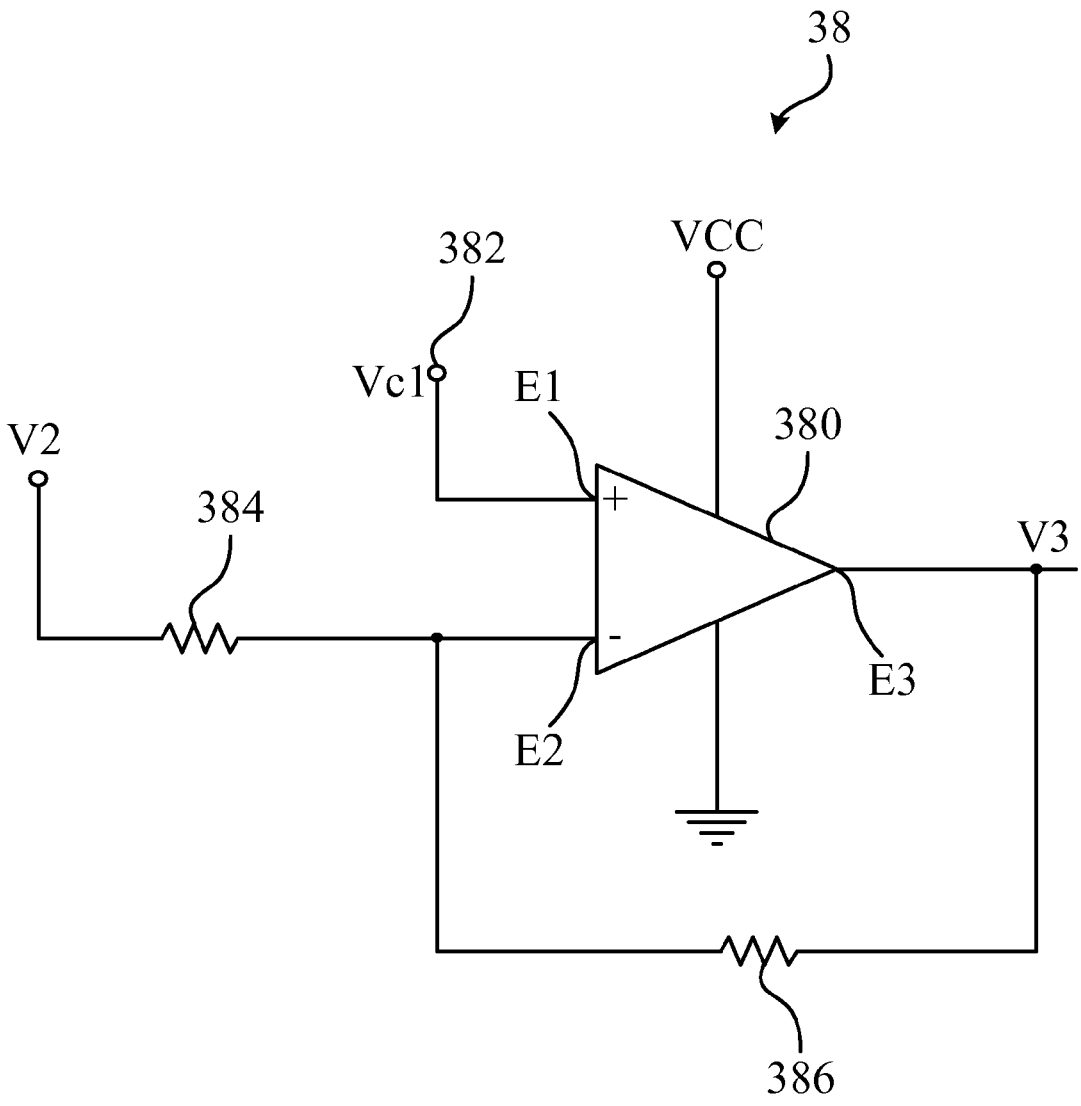
FIG. 3 is a schematic diagram showing a circuit of the voltage feedback controlling module in FIG. 2.

Afterwards, the voltage feedback controlling module 38 converts the second voltage V2 to a third voltage V3 and sends the third voltage V3 to the power adaptor 30 to adjust an output voltage of the power adaptor 30. FIG. 3 is a schematic diagram showing a circuit of the voltage feedback controlling module 38 in FIG. 2. As shown in FIG. 3, the voltage feedback controlling module 38 includes an inverting amplifier 380, a constant voltage source 382, a third resistor 384, and a fourth resistor 386. The inverting amplifier 380 has a first input terminal E1, a second input terminal E2, and a first output terminal E3. The constant voltage source 382 is coupled with the first input terminal E1. The third resistor 384 is coupled with the second input terminal E2, and the second voltage V2 is inputted from one terminal of the third resistor 384. The fourth resistor 386 is coupled with the second input terminal E2 and the first output terminal E3. Furthermore, a power supply voltage VCC is used to provide a power supply needed by the inverting amplifier 380 in operating.

Via the circuit design shown in FIG. 3, the voltage feedback controlling module 38 converts the second voltage V2 to the third voltage V3 according to following equation (1).

$$V3=[(R4+R3)/R3]*Vc1-(R4/R3)*V2. \quad \text{Equation (1):}$$

In equation (1), R4 represents a resistance value of the fourth resistor 386. R3 represents a resistance value of the third resistor 384. Vc1 represents a voltage value provided by the constant voltage source 382.

Figure 4:
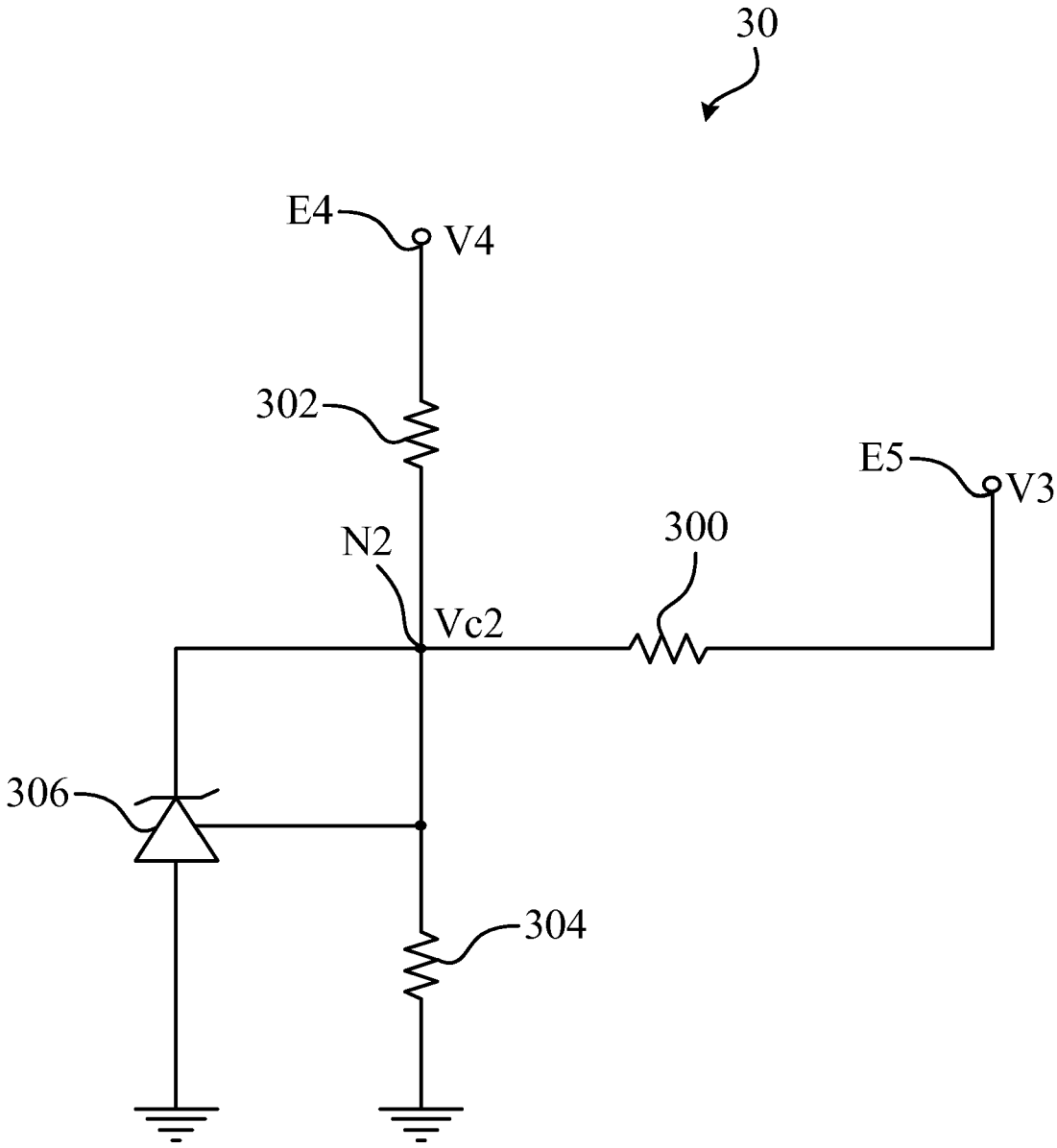
FIG. 4 is a schematic diagram showing a circuit of the power adaptor in FIG. 2.

After receiving the third voltage V3, the power adaptor 30 outputs a fourth voltage V4 according to the third voltage V3. FIG. 4 is a schematic diagram showing a circuit of the power adaptor 30 in FIG. 2. As shown in FIG. 4, the power adaptor 30 has a second output terminal E4, a third input terminal E5, and a node N2. The third input terminal E5 is coupled with the first output terminal E3 of the inverting amplifier 380 in FIG. 3. The power adaptor 30 includes a fifth resistor 300, a sixth resistor 302, a seventh resistor 304, and a voltage regulator 306. The fifth resistor 300 is coupled with the third input terminal E5 and the node N2. The sixth resistor 302 is coupled with the node N2 and the second output terminal E4. The seventh resistor 304 is connected to the ground and coupled with the node N2. The voltage regulator 306 is connected to the ground and coupled with the node N2 and the seventh resistor 304. The voltage regulator 306 is used to regulate the voltage of the node N2 to maintain a constant value.

Via the circuit design shown in FIG. 4, the power adaptor 30 converts the third voltage V3 to the fourth voltage V4 according to following equation (2).

$$V4=\{(Vc2/R7)+[(Vc2-V3)/R5]\}*R6+Vc2. \quad \text{Equation (2):}$$

In equation (2), R5 represents a resistance value of the fifth resistor 300. R6 represents a resistance value of the sixth resistor 302. R7 represents a resistance value of the seventh resistor 304. Vc2 represents a voltage value of the node N2. The fourth voltage V4 is an output voltage of the power adaptor 30.

Figure 5:
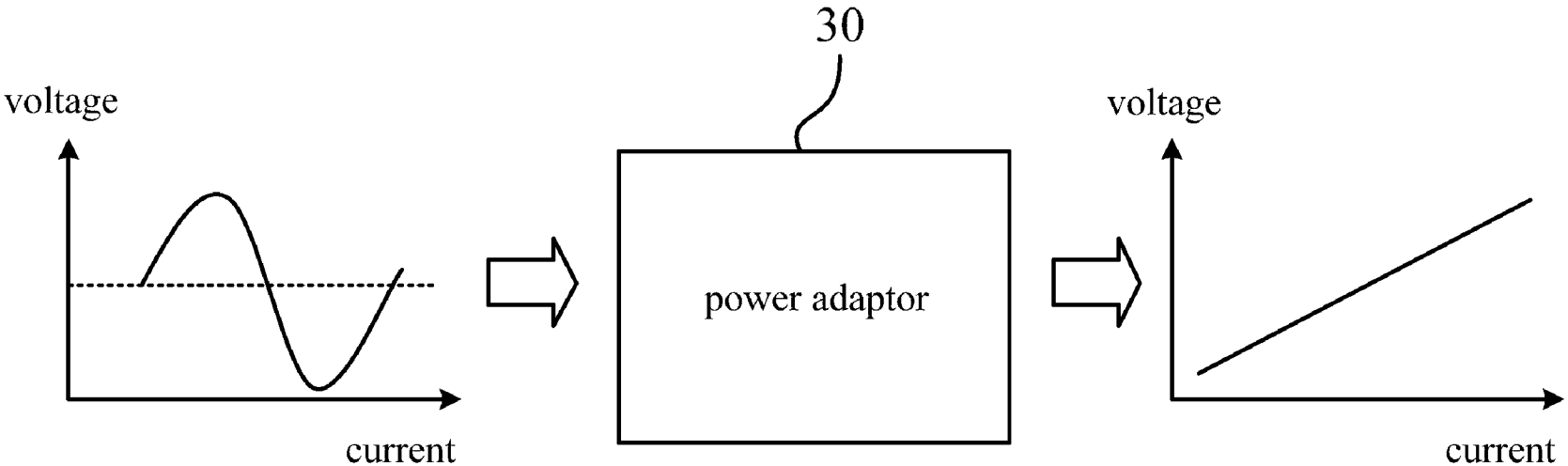
FIG. 5 is a schematic diagram showing the power adaptor in FIG. 2 converting an alternating current to a direct current.

Therefore, the voltage adjusting apparatus 3 of the embodiment can adjust the output voltage of the power adaptor 30 by detecting an output current. FIG. 5 is a schematic diagram showing the power adaptor 30 in FIG. 2 converting an alternating current (AC) to a direct current (DC). When the output current is a light load current, the output voltage of the power adaptor 30 is lower. With increasing of the load, the output voltage of the power adaptor 30 is adjusted up automatically.

A practicable experimental example is taken to describe how to adjust the output voltage of the power adaptor 30 in the embodiment.

First, if an output voltage of the power adaptor 30 is set between 15 V and 19 V, the resistance value R2 of the second resistor 36 should be set to be 8.2 KΩ. Therefore, V2=8.2K*I2.

Then, the resistance value R3 of the third resistor 384 is set to be 10 KΩ. The resistance value R4 of the fourth resistor 386 is set to be 10 KΩ. The voltage value Vc1 provided by the constant voltage source 382 is 1.25 V. According to equation (1), V3=[(10K+10K)/10K]*1.25−(10K/10K)*V2. After calculation, V3 is between 0 V and 2.5 V.

Afterwards, the resistance value R5 of the fifth resistor 300 is set to be 10 KΩ. The resistance value R6 of the sixth resistor 302 is set to be 16.5 KΩ. The resistance value R7 of the seventh resistor 304 is set to be 3.3 KΩ. The voltage regulator 306 regulates the voltage of the node N2 to maintain a constant value of 2.5 V (Vc2). According to equation (2), V4={(2.5/3.3K)+[(2.5−V3)/10K]}*16.5K+2.5. After calculation, V4 is between 15 V and 19 V. V4 is adjusted by V3, and the range of the output voltage of the power adaptor 30 may be adjusted by only modifying the resistance values of the fifth resistor 300, the sixth resistor 302, and/or the seventh resistor 304. According to the above parameters setting, detailed experimental data are shown in table 2.

TABLE 2

| R1 = 10 mΩ; R2 = 8.2 KΩ | | | | | |
|---|---|---|---|---|---|
| I1(A) | V1(mV) | I2(mA) | V2(V) | V3(V) | V4(V) |
| 0.0 | 0 | 0.4 | 0.00 | 2.50 | 15.01 |
| 0.5 | 5 | 50.4 | 0.41 | 2.09 | 15.68 |
| 1.0 | 10 | 100.4 | 0.82 | 1.68 | 16.36 |
| 1.5 | 15 | 150.4 | 1.23 | 1.27 | 17.03 |
| 2.0 | 20 | 200.4 | 1.64 | 0.86 | 17.71 |
| 2.5 | 25 | 250.4 | 2.05 | 0.45 | 18.39 |
| 3.0 | 30 | 300.4 | 2.46 | 0.04 | 19.06 |
| 3.5 | 35 | 350.4 | 2.87 | 0.00 | 19.13 |

Figure 6:
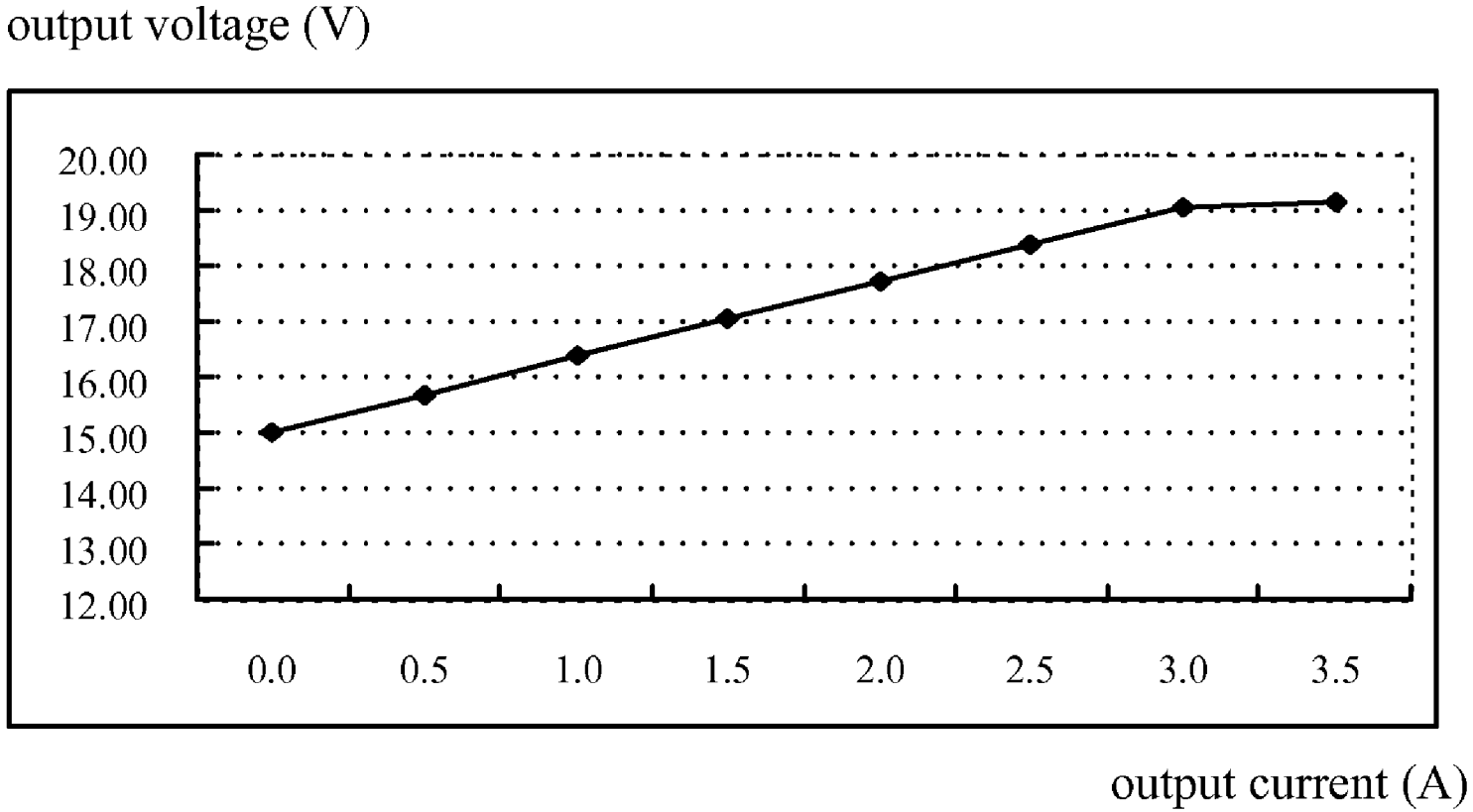
FIG. 6 is a schematic diagram showing the relationship between an output voltage and an output current according to table 2.

FIG. 6 is a schematic diagram showing the relationship between the output voltage V4 and the output current I1 in table 2. When a load current is 0 A, the output voltage is designed to be 15 V. When the load current is 3 A, the output voltage is designed to be 19 V. FIG. 6 shows the variation of the output voltage with different loads.

When the output voltage is different, the voltage adjusting apparatus 3 of the embodiment is used to measure power consumption data of the AC power in of a notebook computer in an idle state, and the data are compared with each other, as shown in table 3. Compared with the electricity used when the output voltage is 19 V, about four percent of electricity is saved when the output voltage of the power adaptor 30 is 15 V. Therefore, the invention can reduce the power consumption of the system input to save energy.

TABLE 3

| output voltage (V) | output of alternating source (W) |
|---|---|
| 19.0 | 31.00 |
| 18.1 | 30.50 |
| 17.0 | 30.20 |
| 16.0 | 30.00 |
| 15.0 | 29.80 |

With the variation of the output current of the power adaptor 30, the power adaptor 30 of the embodiment can adjust the output voltage via the feedback control of the voltage feedback controlling module 38, and the configuration of the original power adaptor is not affected. Furthermore, in the embodiment, the range of the output voltage can be adjusted only by modifying the resistance value of the resistors.

According to the voltage adjusting apparatus of the invention, when the load of an electronic product (such as a notebook computer) is lighter, the output voltage is adjusted down. When the load is heavier, the output voltage is adjusted up. Compared with the prior art, the invention can efficiently reduce the power supply losses to achieve the following advantages. First, energy and electricity is saved. Second, system temperature decreases to improve the reliability of electronic components. Third, a rotation speed of a fan decreases to reduce noise.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A voltage adjusting apparatus, comprising:

a power adaptor outputting a first current;

a first resistor, coupled with the power adaptor, for converting the first current to a first voltage;

a current detecting module, coupled with the first resistor, for converting the first voltage to a second current;

a second resistor, connected to the ground and coupled with the current detecting module, for converting the second current to a second voltage; and a voltage feedback controlling module, coupled with the power adaptor, the current detecting module, and the second resistor, for converting the second voltage to a third voltage, wherein the power adaptor converts the third voltage to a fourth voltage and outputs the fourth voltage, wherein the power adaptor has a second output terminal, a third input terminal and a node, and the power adaptor comprises:

a fifth resistor coupled with the third input terminal and the node;

a sixth resistor coupled with the node and the second output terminal;

a seventh resistor connected to the ground and coupled with the node; and a voltage regulator, connected to the ground and coupled with the node and the seventh resistor, for regulating the voltage of the node to maintain a constant value.

2. The voltage adjusting apparatus according to claim 1, wherein the voltage feedback controlling module comprises:

an inverting amplifier having a first input terminal, a second input terminal, and a first output terminal, wherein the first output terminal is coupled with the third input terminal;

a constant voltage source coupled with the first input terminal;

a third resistor coupled with the second input terminal, wherein the second voltage is inputted from one terminal of the third resistor; and a fourth resistor coupled with the second input terminal and the first output terminal.

* * * * *